US010303087B2

(12) United States Patent
Li et al.

(10) Patent No.: US 10,303,087 B2
(45) Date of Patent: May 28, 2019

(54) REMANUFACTURED TONER CARTRIDGE AND METHOD

(71) Applicant: CLOVER TECHNOLOGIES GROUP, LLC, Ottawa, IL (US)

(72) Inventors: Jun Li, Walnut, CA (US); Eric Tuvesson, Thousand Oaks, CA (US)

(73) Assignee: CLOVER TECHNOLOGIES GROUP, LLC, Hoffman Estates, IL (US)

( * ) Notice: Subject to any disclaimer, the term of this patent is extended or adjusted under 35 U.S.C. 154(b) by 0 days.

(21) Appl. No.: 15/590,498

(22) Filed: May 9, 2017

(65) Prior Publication Data

US 2017/0329256 A1 Nov. 16, 2017

Related U.S. Application Data

(60) Provisional application No. 62/334,216, filed on May 10, 2016.

(51) Int. Cl.
*G03G 15/08* (2006.01)
*G03G 15/16* (2006.01)
*G03G 15/06* (2006.01)

(52) U.S. Cl.
CPC ..... *G03G 15/0882* (2013.01); *G03G 15/0868* (2013.01); *G03G 15/0894* (2013.01);
(Continued)

(58) Field of Classification Search
CPC ..... G03G 15/0894; G03G 15/06; G03G 15/0867; G03G 15/0868; G03G 15/0877;
(Continued)

(56) References Cited

U.S. PATENT DOCUMENTS 4,862,210 A * 8/1989 Woolley ..... G03G 15/0894 399/106
4,895,104 A * 1/1990 Yoshino ..... G03G 15/0882 222/DIG. 1

(Continued)

FOREIGN PATENT DOCUMENTS

EP 1132783 A2 9/2001
EP 1152300 A2 11/2001

(Continued)

OTHER PUBLICATIONS

International Search Report and Written Opinion, International Application No. PCT/US2017/031757, dated Aug. 14, 2017, 10 pages, European Patent Office, HV Rijswijk, NL-2280.

(Continued)

*Primary Examiner* — David J Bolduc
(74) *Attorney, Agent, or Firm* — Matthew G. Gavronski

(57) ABSTRACT

A remanufactured toner cartridge and related method includes a modified driven gear that is associated with an internal seal removal mechanism. The driven gear is modified so that driving rotational force from a printer is not transmitted to the seal removal mechanism during a post test of the remanufactured cartridge. When the post test is complete a fixing member, which may include a pin, is used to return the modified driven gear to an operational configuration so that when the cartridge is subsequently installed in a printer, driving rotational force from the printer is transmitted to the removal mechanism to remove the internal toner seal, thereby permitting cartridge operation.

9 Claims, 8 Drawing Sheets

(52) U.S. Cl.
CPC ..... *G03G 15/1615* (2013.01); *G03G 15/06* (2013.01); *G03G 15/0867* (2013.01); *G03G 15/0877* (2013.01); *G03G 2221/1861* (2013.01)

(58) Field of Classification Search
CPC ..... G03G 15/0882; G03G 15/1615; G03G 2221/1861
See application file for complete search history.

(56) References Cited

U.S. PATENT DOCUMENTS 4,930,684 A * 6/1990 Patterson ..... G03G 15/0894 222/325
5,404,212 A 4/1995 Ditomaso
5,729,795 A * 3/1998 Kavolius ..... G03G 15/0894 399/109
6,029,031 A * 2/2000 Yokomori ..... G03G 15/0894 399/109
7,693,448 B1 4/2010 Lenahan
9,146,503 B2 9/2015 Shindo
9,164,430 B2 10/2015 Murakami et al.
2001/0041080 A1* 11/2001 Higeta ..... G03G 15/0894 399/103
2002/0012546 A1* 1/2002 Chanadi ..... G03G 21/1647 399/106
2002/0025183 A1* 2/2002 Murakami ..... G03G 15/0894 399/109
2002/0054771 A1* 5/2002 Higeta ..... G03G 21/181 399/109
2002/0088138 A1* 7/2002 Murakami ..... F26B 5/12 34/437
2003/0170045 A1 9/2003 Lewis et al.
2005/0028492 A1* 2/2005 Nagashima ..... B29C 65/08 53/471
2005/0281580 A1* 12/2005 Lewis ..... G03G 15/0894 399/109
2006/0133847 A1* 6/2006 Burton ..... G03G 15/0894 399/106
2008/0247775 A1 10/2008 Rummler
2009/0245853 A1 10/2009 Lewis et al.
2011/0293322 A1 12/2011 Shanun et al.
2014/0265159 A1* 9/2014 Shanun ..... G03G 15/0882 277/630
2015/0323887 A1* 11/2015 Tuvesson ..... G03G 15/0808 399/109
2016/0116861 A1* 4/2016 Yamaguchi ..... G03G 15/0868 399/109
2016/0116864 A1* 4/2016 Kase ..... G03G 15/0874 399/109
2016/0124347 A1* 5/2016 Isobe ..... G03G 15/0874 399/109
2016/0306298 A1* 10/2016 Daniels ..... G03G 15/0884
2016/0306299 A1* 10/2016 Daniels ..... G03G 15/0894
2017/0123372 A1* 5/2017 Yamaguchi ..... G03G 15/0868
2017/0235274 A1* 8/2017 Daniels ..... G03G 15/0884 399/109
2017/0336736 A1 11/2017 Perez et al.

FOREIGN PATENT DOCUMENTS

EP 2945021 A1 11/2015
WO 2017/196846 A1 11/2017
WO 2017/201174 A1 11/2017

OTHER PUBLICATIONS

International Search Report and Written Opinion, International Application No. PCT/US2017/033127, dated Jul. 31, 2017, 12 pages, European PatentOffice, HV Rijswijk, NL-2280.
Static Control Remanufacturing Instructions for Brother HL-5250/5350 Toner Cartridge and Drum Unit, Jul. 26, 2013, XP055392369, Retrieved from the Internet: URL: http://www.wbt-berlin.de/anI/AnI_KY/tk, 1110 Reman-ChipInstCombo.pdf, 17 pages.
Non-Final Office Action received for U.S. Appl. No. 15/597,916, dated Sep. 13, 2018, 31 pages.
International Preliminary Report on Patentability received for PCT Application No. PCT/US2017/031757, dated Nov. 22, 2018, 8 pages.

* cited by examiner

REMANUFACTURED TONER CARTRIDGE AND METHOD

CROSS-REFERENCE TO RELATED APPLICATION

This application claims the benefit of and priority to U.S. Provisional Patent Application No. 62/334,216, filed May 10, 2016, the entire contents of which are hereby incorporated by reference herein.

BACKGROUND

The present disclosure relates to consumable cartridges used in image forming apparatuses, and more specifically to a remanufactured cartridge that has been modified to permit testing of the cartridge after the remanufacturing without disturbing a toner seal configuration that reduces leakage of toner from the cartridge during shipping.

Imaging cartridges, and particularly toner cartridges, are frequently provided with toner seals that cover a toner opening provided in the toner hopper through which toner is dispensed during operation of the cartridge. These seals are removable either manually by a user or by a mechanism included in the toner cartridge or the image forming apparatus into which it is installed just prior to the toner cartridge being used for a printing operation. The primary function of the seal is to prevent toner from leaking out of the toner opening of the cartridge during transportation and shipping of the toner cartridge.

Toner cartridge remanufacturers often perform a post test of the remanufactured cartridges after they have gone through the remanufacturing process but before they are packaged for sale to the end user. The post test is intended to reveal any issues that may have arisen during the remanufacturing process. If the post test reveals a printing defect the cartridge can be removed from the production line and the issue investigated. Although the specific technique may vary depending on the configuration of a specific cartridge, to conduct a post test remanufacturers will often insert a relatively small test charge of toner into the space between the developer roller and the "clean" side of the toner seal. In a typical post test the toner seal remains intact and print tests are conducted using the test charge of toner which makes its way through the cartridge in the same manner as toner from the hopper would if the toner seal was not present. When the post test is complete, remaining test charge toner may be vacuumed or blown from the cartridge before packaging.

Toner cartridges such as those disclosed in U.S. Pat. No. 9,146,503 (the '503 patent) include a rotatable member within the toner hopper that removes an internal toner seal. Before the cartridge is inserted into a printer, the internal toner seal prevents toner from leaking out of a toner accommodating area, which in the case of the '503 patent is in the form of a flexible container. When the cartridge is inserted into the printer, driving rotatable force from the printer is transmitted to the cartridge through a drive mechanism. The drive mechanism operates a gear assembly in the cartridge which in turn rotates the rotatable member. When the rotatable member rotates it pulls the internal toner seal away from the toner accommodating area, thereby allowing toner to flow through the cartridge toward the developer roller. Because the internal toner seal is automatically removed when the cartridge is inserted into the printer, post testing a cartridge that is remanufactured back to its original configuration would cause the internal toner seal to be removed, resulting in undesirable leaking of toner from the cartridge during packaging and shipment.

SUMMARY

In some aspects, a remanufactured end assembly for a toner cartridge comprises a driving force receiver for receiving a rotating driving force from a printer, and a driven gear associated with at least one rotatable component of the toner cartridge. The driven gear includes a first portion that receives driving rotatable force from the driving force receiver, and a second portion that transmits driving rotatable force to the at least one rotatable component. The driven gear has a coupled configuration in which the first portion and the second portion are coupled for rotation together, and an uncoupled configuration in which the first portion and the second portion are rotatable relative to one another. An end cap at least partially covers the driven gear and defines an end cap opening that facilitates securing the driven gear in the coupled configuration.

In some embodiments the at least one rotatable component includes a seal puller for removing an internal toner seal. The remanufactured end assembly may further include a fixing member securing the driven gear in the coupled configuration, and the fixing member may include a pin that is inserted between the first portion and the second portion of the driven gear. In other embodiments the fixing member may include a sonic weld securing the first portion and the second portion of the driven gear. The end cap opening may be positioned to permit application of the fixing member to the driven gear. In some embodiments the end cap is a used end cap and the end cap opening is formed in the used end cap during a remanufacturing process.

The remanufactured end assembly may further include a gear housing positioned between the driven gear and the end cap. The gear housing may define a gear housing opening substantially aligned with the end cap opening to facilitate securing the driven gear in the coupled configuration. In some embodiments the gear housing is a used gear housing and the gear housing opening is formed in the used gear housing during a remanufacturing process.

The remanufactured end assembly may further include a gear plate positioned between the driven gear and the gear housing. The gear plate may define a gear plate opening substantially aligned with the gear housing opening to facilitate securing the driven gear in the coupled configuration. In some embodiments the gear plate is a used gear plate and the gear plate opening is formed in the used gear plate during a remanufacturing process.

In other aspects, a method of remanufacturing an imaging cartridge to permit a post test of the cartridge without activating a removal mechanism associated with an internal toner seal of the cartridge includes disassembling the cartridge, removing at least one component that overlies a member that provides driving force to the removal mechanism, replacing the member with a modified member having a coupled configuration that provides driving force to the removal mechanism and an uncoupled configuration that does not provide driving force to the removal mechanism, at least partially reassembling the cartridge, post testing the cartridge with the modified member in the uncoupled configuration, and placing the modified member in the coupled configuration.

In some embodiments, replacing the member with a modified member includes installing a driven gear including a first portion that receives driving rotatable force from a driving force receiver, and a second portion that transmits driving rotatable force to the removal mechanism, where the first portion and the second portion are configured such that in the coupled configuration the first portion and the second portion are coupled for rotation together, and such that in the uncoupled configuration the first portion and the second portion are rotatable relative to one another.

In some embodiments placing the modified member in the coupled configuration includes applying a fixing member to couple the first portion and the second portion for rotation together. Applying the fixing member may include inserting a pin between the first portion and the second portion. Applying the fixing member may also or alternatively include sonically welding the first portion to the second portion.

In some embodiments the method also includes modifying at least a portion of an end assembly of the cartridge to provide access to the modified member for placing the modified member in the coupled configuration. Modifying at least a portion of the end assembly of the cartridge may include forming an end cap opening in an end cap.

In still other aspects, a remanufactured toner cartridge includes a driving force receiver for receiving a rotating driving force, a developer roller drivingly coupled with the driving force receiver and rotating in response to the driving force receiver receiving the rotating driving force, and a driven gear operable to drive an internal toner seal removal mechanism. The driven gear includes a first portion that receives driving rotatable force via the driving force receiver, and a second portion that transmits driving rotatable force to the internal toner seal removal mechanism. The driven gear has a coupled configuration in which the first portion and the second portion are coupled for rotation together, and an uncoupled configuration in which the first portion and the second portion are rotatable relative to one another. The remanufactured toner cartridge also includes an end assembly at least partially covering the driven gear and defining at least one opening that provides access to the driven gear for placing the driven gear in the coupled configuration. In some embodiments, the remanufactured toner cartridge also includes a fixing member installed via the opening and securing the driven gear in the coupled configuration.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figure 1:
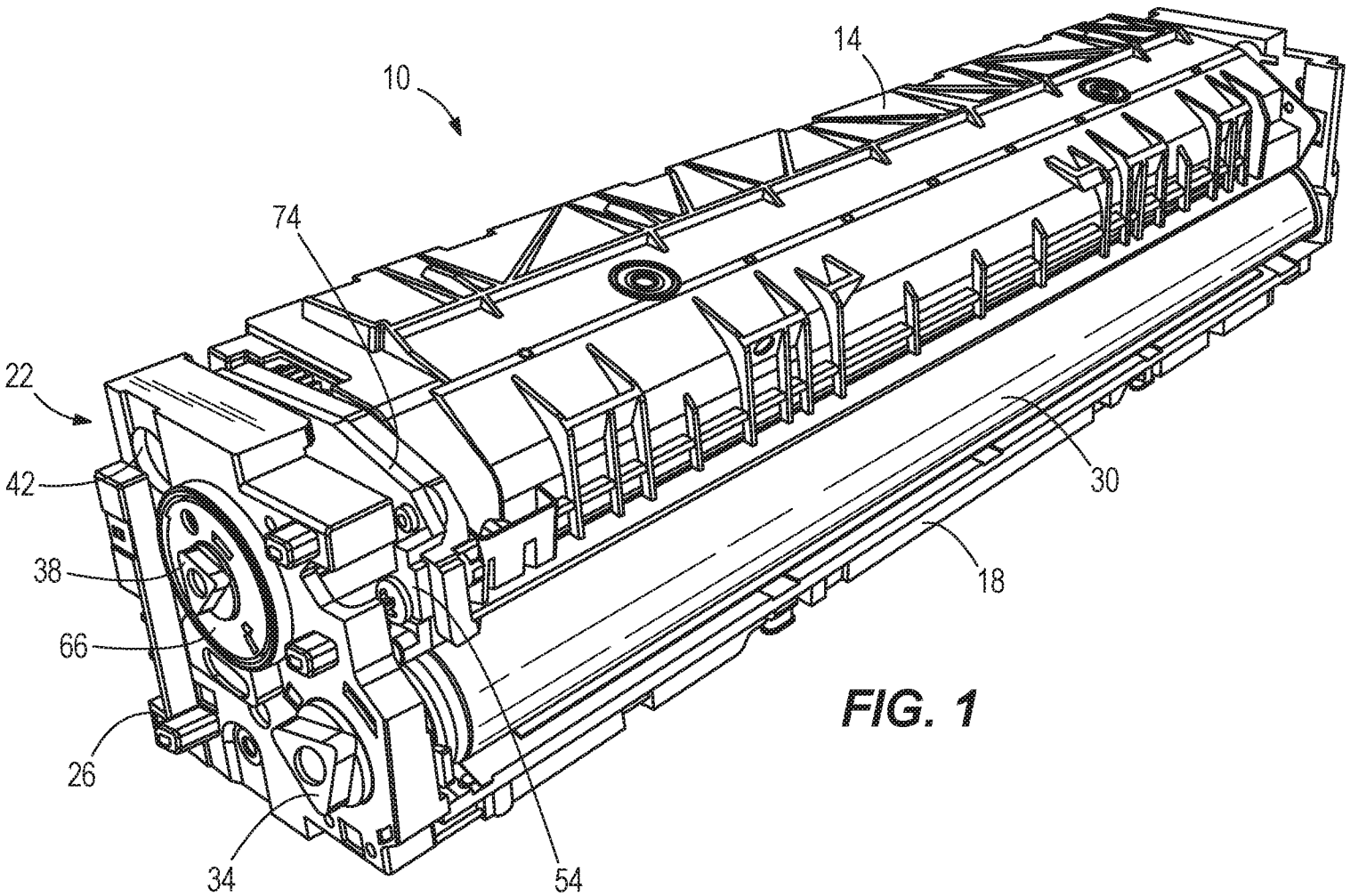
FIG. 1 is a perspective view of a remanufactured toner cartridge that has been modified from its original configuration to permit the cartridge to be post tested after remanufacturing.

FIG. 1 illustrates a remanufactured toner cartridge 10 that includes various modifications that prevent the removal of an internal toner seal during post testing of the cartridge 10 after remanufacturing. In the illustrated example the toner cartridge 10 is a Hewlett-Packard brand M252 color toner cartridge; however, it should be appreciated that the teachings provided herein may be utilized in connection with various other toner cartridges having similar features or characteristics. As used herein, the term "modified" shall be construed as including original parts that have been modified, for example by subjecting them to cutting, drilling, or other machining or fabrication operations, as well as non-original replacement parts that, other than the described modifications, are substantially similar in design to the original part or parts they are replacing.

The toner cartridge 10 includes a hopper section 14 and a waste section 18 coupled to the hopper section 14. A drive end 22 includes a drive end cap 26 and is configured to receive driving rotatable force from a printer that receives the cartridge 10. An OPC drum 30 is rotatably mounted within the waste section 18 and an OPC drive projection 34 extends through an opening in the drive end cap 26 to receive driving rotatable force from the printer. A hopper drive projection 38 extends through another opening in the drive end cap 26 and also receives driving rotatable force from the printer.

Figure 3:
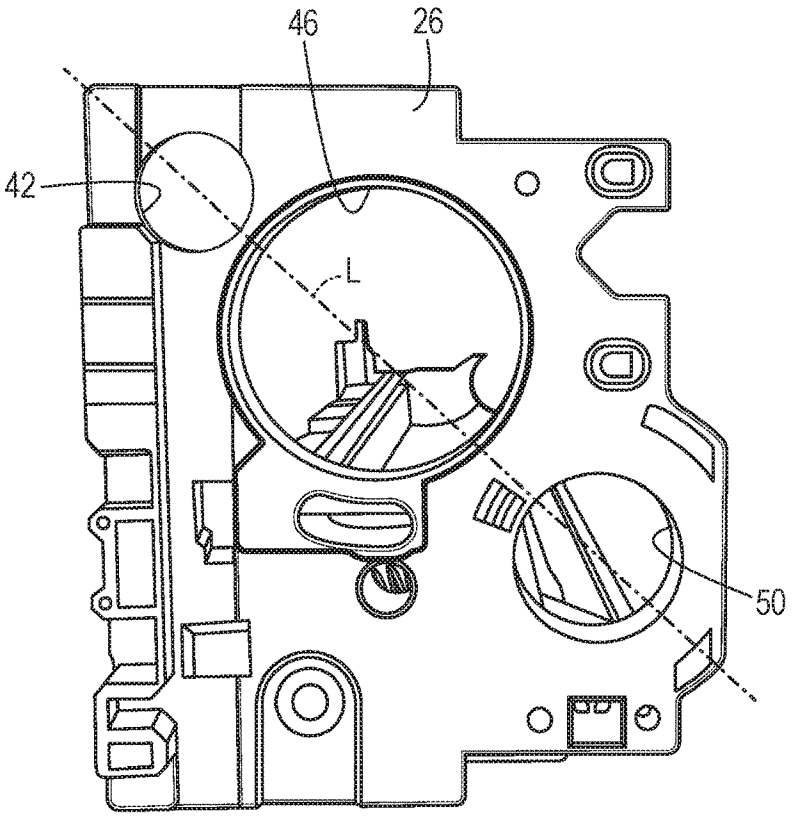
FIG. 3 is an end view showing a modified drive receiving side end cap for the toner cartridge of FIG. 1.
Figure 2:
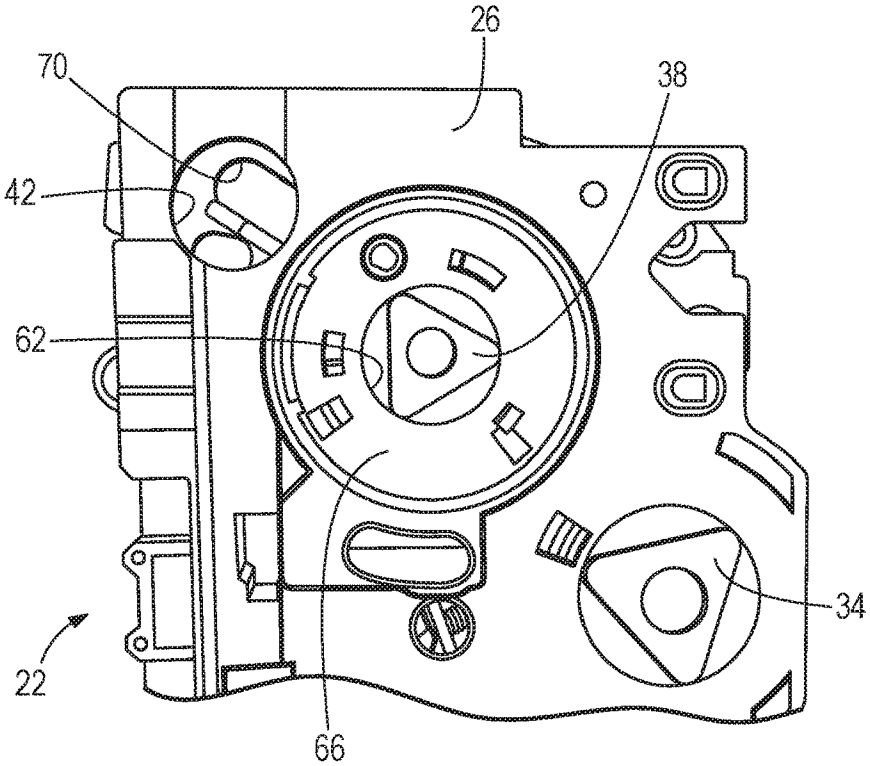
FIG. 2 is an end view of the toner cartridge of FIG. 1 showing the drive receiving side of the toner cartridge.

Referring also to FIGS. 2 and 3, a first cartridge modification includes a modification to the drive end cap 26. More specifically, the drive end cap 26 has been provided with an end cap opening 42 that provides access to an interior area of the drive end cap 26 for reasons discussed further below. In the illustrated configuration the end cap opening 42 is smaller than both a hopper drive opening 46 that receives the hopper drive projection 38 and an OPC drive opening 50 that receives the OPC drive projection 34. Moreover, when viewed along the axis of the OPC drum 30, a line L drawn through the centers of the hopper drive opening 46 and the OPC drive opening 50 passes through the end cap opening 42.

Figure 4:
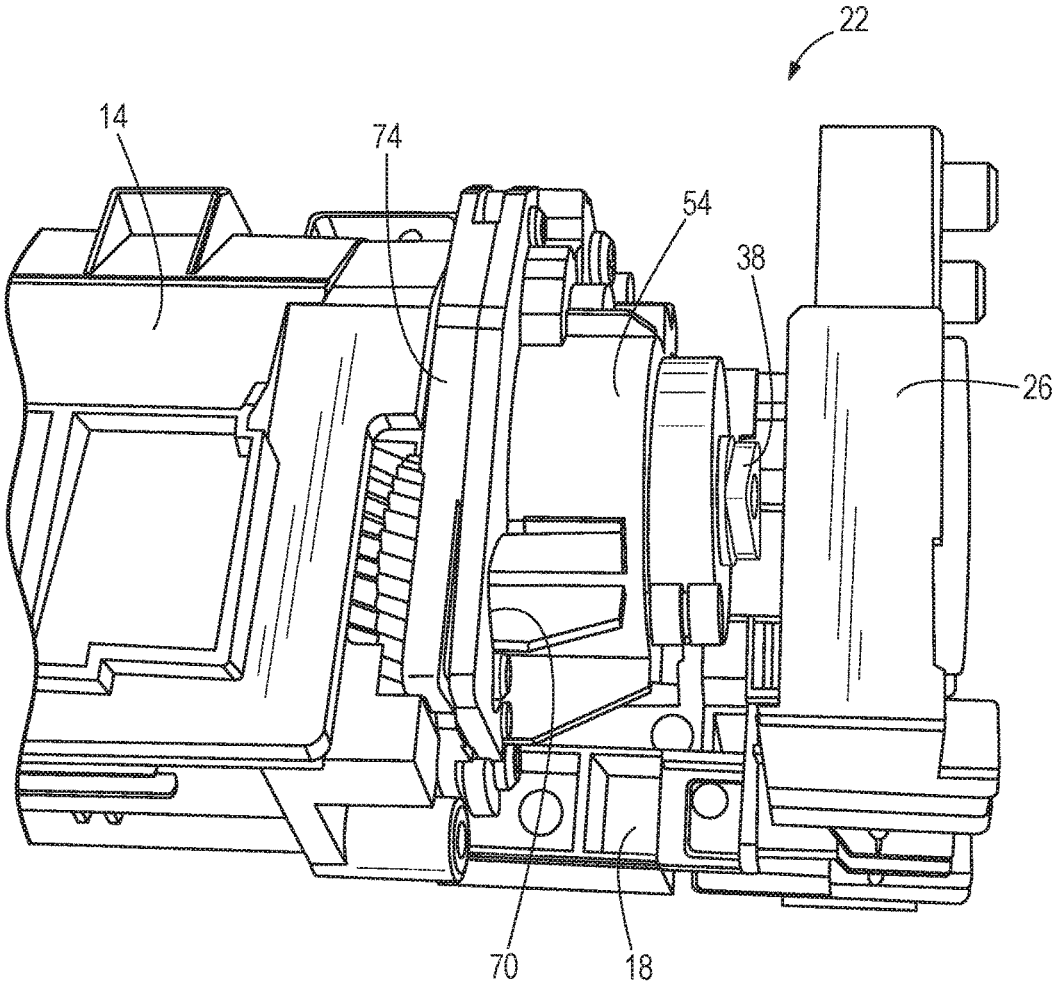
FIG. 4 is a top view of the drive receiving side of the toner cartridge of FIG. 1 in a partially exploded configuration.
Figure 5:
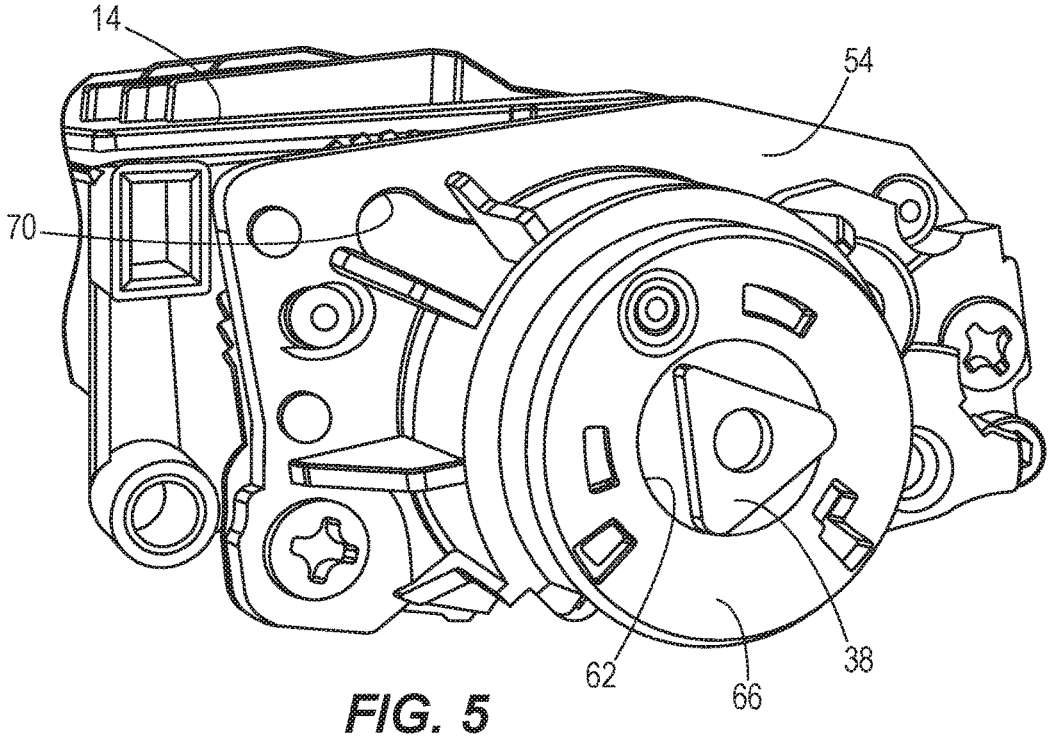
FIG. 5 is an end view of the drive receiving side of a hopper section of the toner cartridge of FIG. 1, including a modified gear housing.
Figure 6:
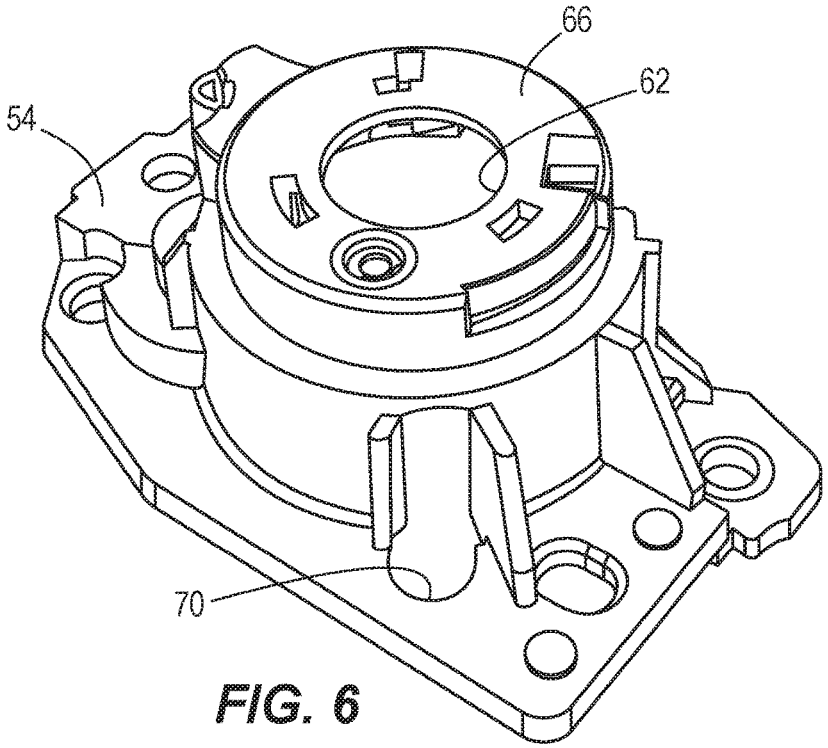
FIG. 6 is a perspective view of the modified gear housing of FIG. 5.

Referring also to FIGS. 4-6, a second cartridge modification includes a modification to a gear housing 54 that is coupled to the hopper section 14. The gear housing 54 receives and supports a gearset assembly 58 (FIG. 7) that includes the hopper drive projection 38. As shown, the hopper drive projection 38 extends through a housing drive opening 62 in the gear housing 54. In the illustrated configuration, an end face 66 of the gear housing 54 is received by the hopper drive opening 46 of the drive end cap 26 such that the end face 66 is visible through the hopper drive opening 46 (see FIG. 2). The gear housing 54 is modified by providing a gear housing opening 70 in the gear housing 54. The gear housing opening 70 is configured and arranged such that when the modified cartridge 10 is assembled the gear housing opening 70 is substantially aligned with the end cap opening 42 when the cartridge 10 is viewed along the axis of the OPC drum 30 (see FIG. 2).

Figure 7:
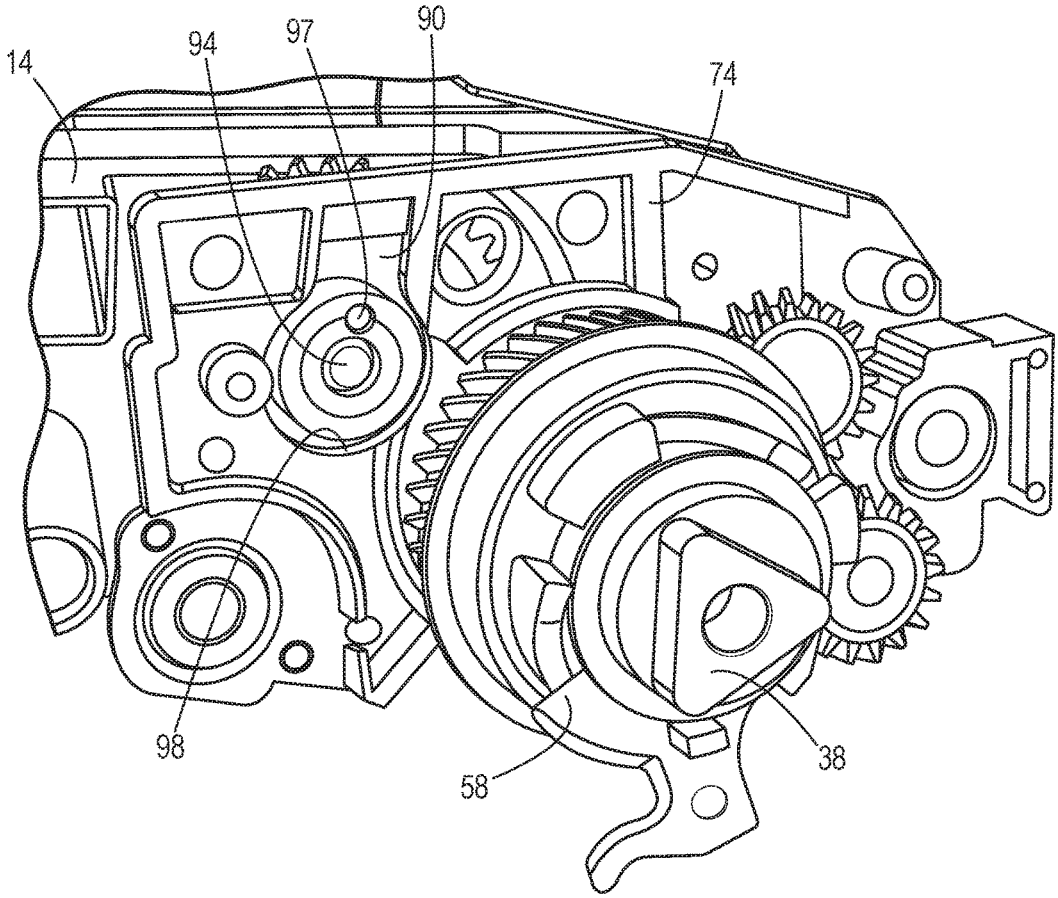
FIG. 7 is an end view of the drive receiving side of the hopper section of FIG. 5 with the gear housing removed and showing a modified gear support plate.
Figure 8:
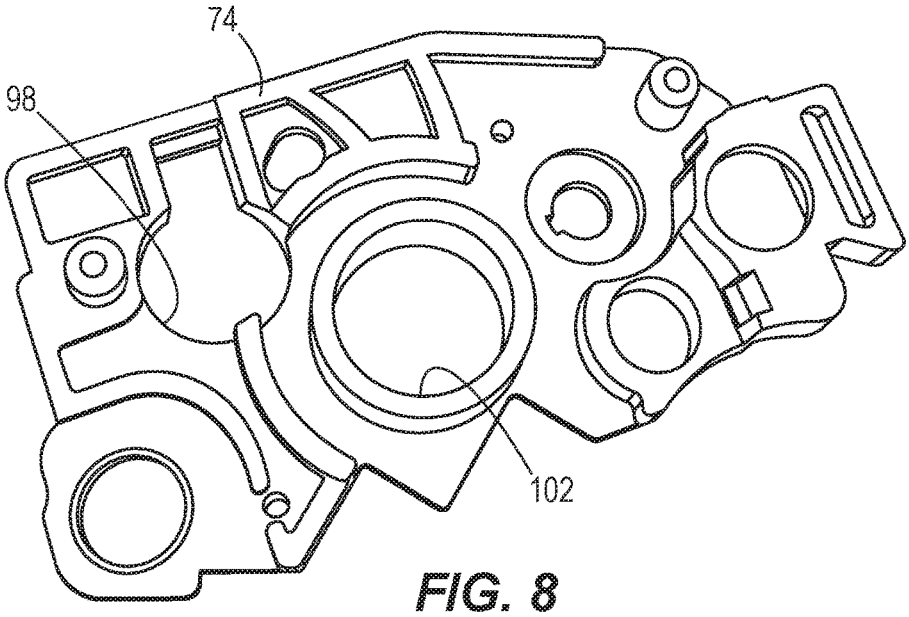
FIG. 8 is a perspective view of the modified gear support plate of FIG. 7.
Figure 9:
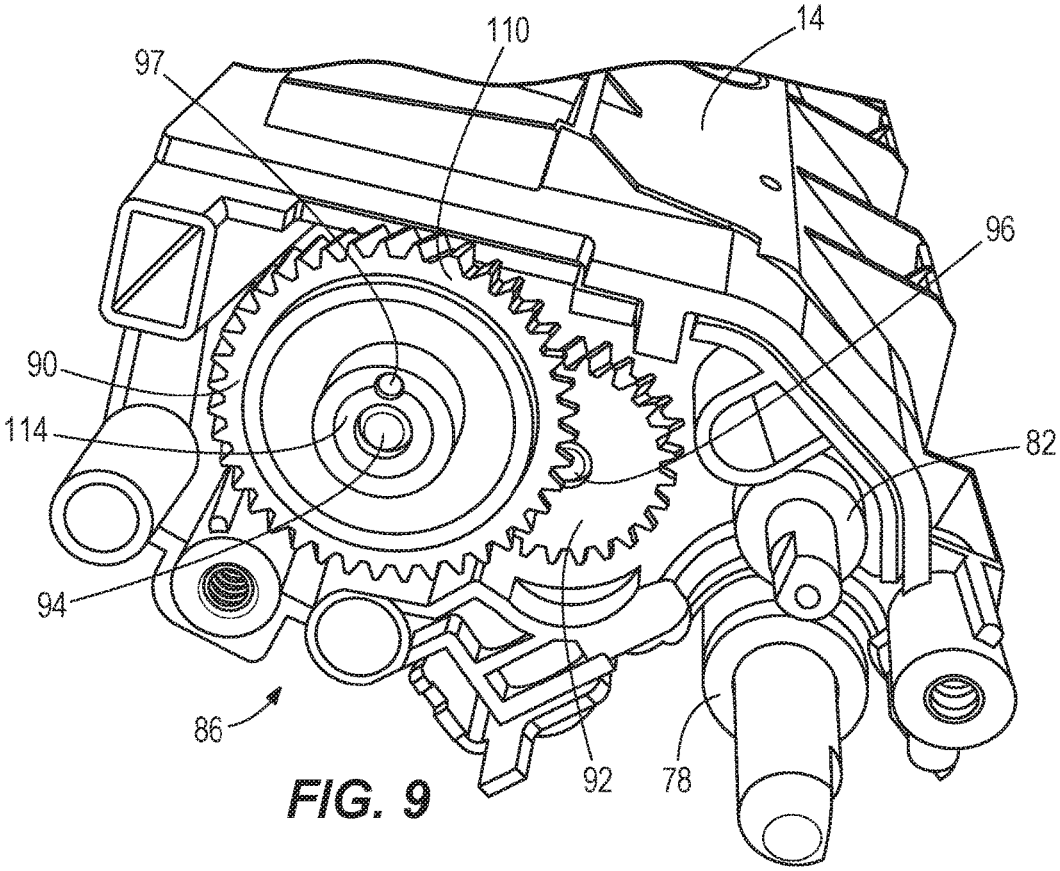
FIG. 9 is an end view of the drive receiving side of the hopper section of FIG. 5 with the gear housing, a gearset, and the gear support plate removed to reveal a modified gear.

Referring also to FIGS. 7-9, a gear support plate 74 is coupled to the hopper section 14 and supports the gearset assembly 58. In the illustrated embodiment the gearset assembly 58 includes a clutch assembly for selectively transmitting rotational driving force received from the printer to various components of the cartridge 10. The illustrated gearset assembly 58 includes several driving gears for driving different components of the cartridge 10, including, for example, a developer roller 78 (FIG. 9), a supply roller 82 (FIG. 9), and a combination toner agitator and seal removal mechanism 86 (FIG. 9). As shown in FIG. 9, the removal mechanism 86 includes a primary driven gear 90 that receives driving rotational force from one of the driving gears of the gearset assembly 58, and a secondary driven gear 92 that receives driving rotational force from the primary driven gear 90. The primary driven gear 90 is rotatably mounted upon a fixed shaft 94 provided on the hopper section 14, and the secondary driven gear 92 is non-rotatably mounted upon a drive shaft 96 of the removal mechanism 86 such that rotation of the secondary driven gear 92 rotates the drive shaft 96 and, thus, the removal mechanism 86.

As discussed further below with respect to FIGS. 10*a*, 10*b*, and 10*c*, the primary driven gear 90 may be or include a modified primary driven gear 106 that includes an outer gear portion 110 and an inner gear portion 114 rotatably positioned on the fixed shaft 94. The outer gear portion 110 and inner gear portion 114 may cooperate to define a fixing location 97 that allows the outer gear portion 110 and inner gear portion 114 to be coupled for rotation with one another, for reasons discussed below.

As shown in FIGS. 7 and 8, a third cartridge modification includes a modification to the gear support plate 74 in the form of a support plate opening 98. The support plate opening 98 is formed substantially adjacent to a gearset opening 102 provided in the support plate 74 and in the illustrated configuration is substantially keyhole-shaped. As seen in FIG. 7, the support plate opening 98 is substantially aligned with the rotational axis of the shaft 94 and when viewed along the axis of the shaft 94 exposes the fixing location 97 of the driven gear 90. As seen in FIG. 2, portions of the support plate opening 98 are aligned with both the end cap opening 42 and with the gear housing opening 70 such that, when the cartridge 10 is assembled and the primary driven gear 90 is in the proper rotational orientation, the fixing location 97 is accessible through the end cap opening 42, the gear housing opening 70, and the support plate opening 98, for reasons that will become apparent below.

Although not shown, removal mechanism 86 is configured such that upon rotation of the primary driven gear 90 the removal mechanism 86 rotates to remove an internal toner seal from a toner accommodating area within the hopper section 14. When the internal toner seal is removed, toner is allowed to pass through the hopper section 14 toward the supply roller 82 and the developer roller 78 as described, for example, in the '503 patent. The internal toner seal is provided to prevent toner from leaking from the cartridge 10 during shipping. When a user initially installs the cartridge in the printer, the printer drive mechanism drives the removal mechanism 86 via the gearset assembly 58, the toner seal is automatically removed, and printing may commence. When a cartridge is remanufactured, it is often desirable to print several test pages before final packaging and shipment to confirm that the cartridge prints well and the remanufacturing process has been successful. For cartridges having internal seals like those described in the '503 patent, the automatic nature of the seal removal system creates a problem in that any post test of a cartridge remanufactured to its original OEM configuration will cause the seal to be removed, possibly leading to undesirable leaking of toner from the cartridge during shipping.

Figure 10A:
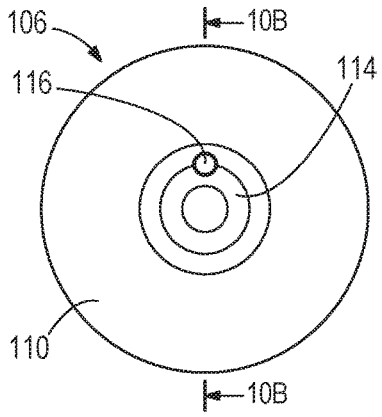
FIGS. 10*a*, 10*b*, and 10*c* are front, section, and rear views of the modified gear of FIG. 8.
Figure 10B:
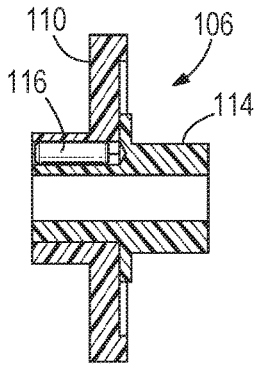
Figure 10C:
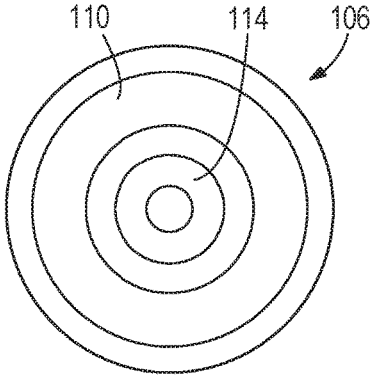
Figure 11A:
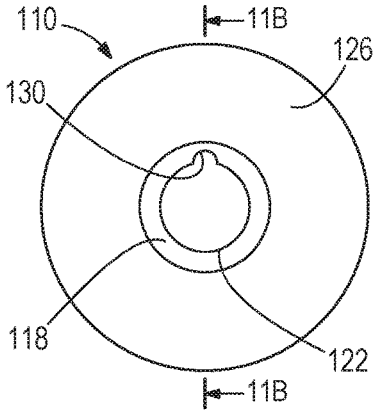
FIGS. 11*a*, 11*b*, and 11*c* are front, section, and rear views, respectively, of an outer portion of the modified gear of FIG. 10*a*.
Figure 11B:
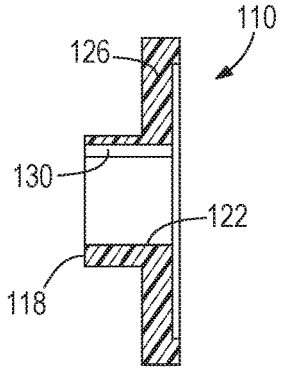
Figure 11C:
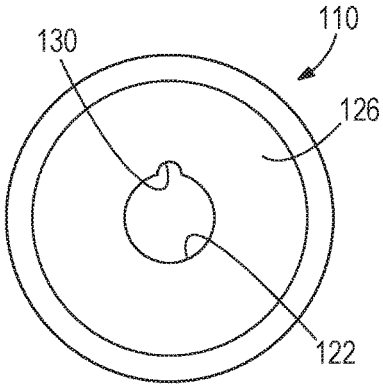
Figure 12A:
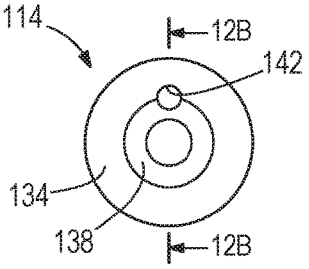
FIGS. 12*a*, 12*b*, and 12*c* are front, section, and rear views, respectively, of an inner portion of the modified gear of FIG. 10*a*.
Figure 12B:
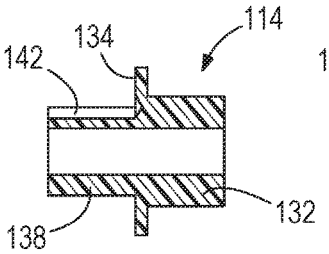
Figure 12C:
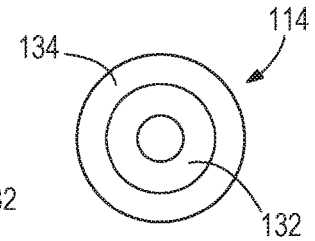

Referring now to FIGS. 10*a*, 10*b*, and 10*c*, a modified primary driven gear 106 is shown and is configured to selectively prevent transmission of driving rotational force from the gearset assembly 58 to the removal mechanism 86 to permit post testing of a remanufactured cartridge 10 without removing the internal seal. More specifically, the modified primary driven gear 106 includes the outer gear portion 110, shown in detail in FIGS. 11*a*, 11*b*, and 11*c*, and the inner gear portion 114 shown in detail in FIGS. 12*a*, 12*b*, and 12*c*, that can be selectively coupled for rotation with the outer gear portion 110 by way of a fixing member 116, which in the illustrated configuration includes a pin. In this way, the driven gear 106 includes a coupled configuration in which the inner gear portion 114 and outer gear portion 110 are coupled for rotation together, and an uncoupled configuration in which the inner gear portion 114 and the outer gear portion 114 are rotatable relative to one another.

The outer gear portion 110 includes a generally cylindrical central portion 118 defining a through bore 122 and a flange portion 126 extending outwardly from the central portion 118. The outer circumference of the flange portion 126 defines gear teeth (not illustrated) that are configured for engagement with one of the driving gears provided on the gearset assembly 58. The inner surface of the through bore 122 includes an axially extending semi-cylindrical groove 130 for receiving the fixing member 116.

The inner gear portion 114 includes a first cylindrical portion 132, a central flange portion 134, and a second cylindrical portion 138 on an opposite side of the flange portion 134 as the first cylindrical portion 132. The outer surface of the first cylindrical portion 132 includes gear teeth (not illustrated) configured for engagement with the secondary driven gear 92. The second cylindrical portion 138 is sized to fit within the through bore 122 provided in the central portion 118 of the outer gear portion 110. In the illustrated embodiment, an outer surface of the second cylindrical portion 138 defines an axially extending semi-cylindrical groove 142 that is alignable with the groove 130 to receive the fixing member 116. When the inner gear portion 114 is assembled with the outer gear portion 110 the central flange portion 134 functions as a stop to properly axially locate the inner and outer portions 114, 110 with respect to one another. When the grooves 130, 142 are aligned they define a substantially cylindrical bore for receiving the fixing member 116, which in the illustrated embodiment comprises a cylindrical pin. This bore corresponds to the fixing location 97 shown in FIG. 9. Thus, when the grooves 130, 142 are aligned and the fixing member 116 is inserted therein the driven gear 106 is in the coupled configuration and the inner and outer gear portions 114, 110 are coupled for rotation together about the shaft 94. When the fixing member 116 is removed or otherwise not present, the driven gear 106 is in the uncoupled configuration and the inner and outer gear portions 114, 110 are rotatable relative to one another. By placing the driven gear 106 in the uncoupled configuration, driving rotatable force provided by the printer upon cartridge installation may be prevented from driving the removal mechanism 86, as described further below.

Although the illustrated embodiment relies on a cylindrical fixing member 116 to fix the inner and outer gear portions 114, 110, other embodiments may also or alternatively include a fixing member 116 in the form of a square or other alternatively shaped pin. In still other embodiments, the fixing member 116 may be or include adhesives, other types of fasteners, sonic welding, or a combination of these, that function(s) to fix the inner and outer gear portions 114, 110 to one another.

Figure 13:
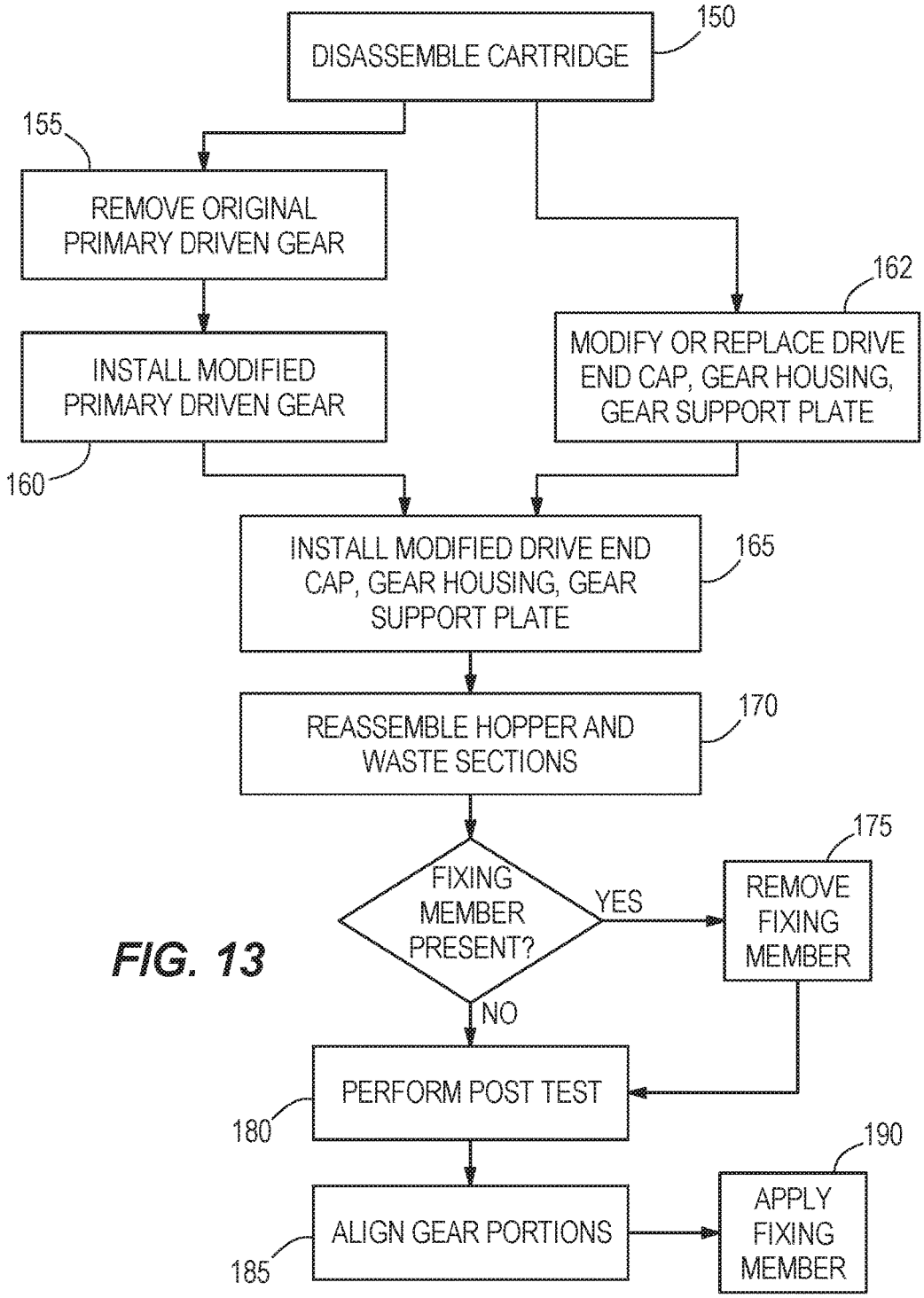
FIG. 13 is a flow chart showing an exemplary method of remanufacturing the toner cartridge of FIG. 1.

Referring also to FIG. 13, a method of remanufacturing the toner cartridge 10 includes at least partially disassembling the cartridge 10 as at 150. Disassembling the cartridge 10 may include, among other things, separating the hopper section 14 from the waste section 18 and removing the gear housing 54, gearset assembly 58, and gear support plate 74 from the hopper section 14. In some instances the gear housing 54, gearset assembly 58, and gear support plate 74 may be removed as a unit. The original primary driven gear 90 may then be removed as at 155, and the modified or replacement primary driven gear 106, including the outer gear portion 110 and the inner gear portion 114 may be installed on the fixed shaft 94 as at 160. Installing the inner gear portion 114 on the fixed shaft 94 may include orienting the inner gear portion 114 such that the groove 130 will be aligned with the support plate opening 98 when the support plate 98 is reinstalled.

The drive end cap 26, the gear housing 54, and the gear support plate 74 are each modified or replaced as at 162 to provide the end cap opening 42, the gear housing opening 70, and the support plate opening 98, respectively. This step may include one or more machining operations to modify one or more of the drive end cap 26, gear housing 54, and gear support plate 74, to form the respective openings 42, 70, 98. This step may alternatively include replacing one or more of the drive end cap 26, gear housing 54, and gear support plate 74 with a new replacement component that has the respective opening 42, 70, 98 already formed therein. In some embodiments involving modification of the drive end cap 26, gear housing 54, and gear support plate 74, the openings 42, 70, 98 may be formed by a single machining operation performed on the components while assembled to each other or assembled to a complete cartridge 10. In other embodiments components may be modified in batches, with the drive end caps 26, gear housings 54, and gear support plates 74 of several cartridges 10 being collected and modified in bulk and subsequently returned to an assembly line for installation on cartridges undergoing the remanufacturing process.

With the modified primary driven gear 106 installed, the modified gear support plate 74, gearset assembly 58, and gear housing 54 (which may be or include replacement components) may be installed on the hopper section 14 as at 165. The hopper section 14 and the waste section 18 may then be reassembled as at 170. As understood by those skilled in the art, at some point during the remanufacturing process the hopper section 14 will be refilled with toner and a replacement internal toner seal will be installed. Other components of the cartridge 10 that require cleaning or replacement may also be cleaned or replaced. In some cartridges complete reassembly before the post test may not be required, and one or more cartridge components may be left off the cartridge until the post test is complete.

Depending on the specifics of a particular cartridge and/or manufacturing process, the fixing member 116 may or may not be present on or in the primary driven gear 106 when the primary driven gear 106 is installed on the shaft 94 in step 160. Stated another way, the primary driven gear 106 may be in either the coupled configuration or the uncoupled configuration. If the primary driven gear 106 is in the coupled configuration during step 160, the fixing member 116 may be disabled or removed from the modified primary driven gear 106 as at 175 before performing a post test as at 180. Removal of the fixing member 116 may include using a suitable tool to reach through the end cap opening 42, the gear housing opening 70, and the support plate opening 98 to remove or otherwise disable the fixing member 116. In other embodiments the primary driven gear 106 may be in the uncoupled configuration upon initial installation onto the shaft 94, and there will be no need to remove a pin or other fixing component before performing the post test.

As understood by those skilled in the art, the post test includes supplying a relatively small amount of test toner to the supply roller 82 and/or the developer roller 78 and installing the remanufactured cartridge 10 into a printer. During the post test, driving rotational force provided by the printer rotates the gearset assembly 58 by way of the hopper drive projection 38. The gearset assembly 58 in turn rotates the outer gear portion 110 about the shaft 94; however, because the primary driven gear 106 is in the uncoupled configuration, the outer gear portion 110 rotates freely around the inner gear portion 114, which remains stationary due to rotational resistance provided by the removal mechanism 86 by way of the secondary driven gear 92. Even with the primary driven gear 106 in the uncoupled configuration, driving rotatable force is nonetheless provided to the supply roller 82, developer roller 78, and OPC drum 30. Thus, the post test may be completed to confirm proper operation of the image-generating components of the cartridge 10 without activating the removal mechanism 86 and removing the internal seal.

When the post test 180 is complete, the cartridge 10 is removed from the printer. Remaining test toner may be blown, vacuumed, or otherwise removed from the cartridge. With the cartridge 10 removed from the printer, driving rotational force may be applied to the hopper drive projection 38, for example by a suitable hand or power tool, to rotate the gearset assembly 58 and outer gear portion 110. In embodiments in which the fixing member 116 is a pin or other component that fits into the inner and outer gear portions 114, 110, the outer gear portion 110 is rotated into alignment with the inner gear portion 114 as at 185, for example to align the groove 130 in the outer gear portion 110 with the groove 142 on the inner gear portion 114. With the inner and outer gear portions 114, 110 properly aligned the fixing member 116 may be applied, installed, or reinstalled as the case may be as at 190, thereby placing the primary driven gear 106 in the coupled configuration. In embodiments where the fixing member 116 is a pin, the pin may be installed by passing it through the end cap opening 42, the gear housing opening 70, and the support plate opening 98 and inserting the fixing member 116 into the grooves 130, 142. In alternative embodiments using adhesive or ultrasonic welding to join the inner and outer portions 114, 110, the previously described alignment step may not be required. Rather, the inner and outer portions 114, 110 may be glued, welded, or otherwise joined to one another, without regard to their relative rotational positions, by inserting a syringe, welding horn, or other suitable tool or applicator through the end cap opening 42, the gear housing opening 70, and the support plate opening 98 to apply or weld or otherwise activate the fixing member, thereby placing the primary driven gear 106 in the coupled configuration. If desired a cap or plug (not shown) may be installed on or into the end cap opening 42 to cover the fixing member 116.

With primary driven gear 106 in the coupled configuration, when the remanufactured cartridge 10 is subsequently installed into a printer, driving rotational force from the printer is applied to the hopper drive projection 38 and gearset assembly 58, which rotates the primary driven gear 106, which in turn rotates the secondary driven gear 92 and activates the removal mechanism 86 to remove the internal toner seal. Upon removal of the internal toner seal the remanufactured cartridge 10 operates in substantially the same manner as an original new cartridge.

It should be appreciated that the exemplary description provided above refers to one specific style of toner cartridge, but that the teachings and concepts set forth may be applied to a variety of toner cartridges having different forms of construction. For example, other toner cartridges may have a different arrangement of caps, covers, or housings such that more or fewer access openings, such as the openings 42, 70, and 98, are required. Similarly, other toner cartridges may have a different drive arrangement with different configurations or numbers of gears or other driving or linking components for activating an internal toner seal removal mechanism. In addition, the method steps described above are not necessarily required to be performed in the order in which they are described, and not all method steps will be necessary for all types of toner cartridges.

Accordingly, the scope of the invention shall be defined by the following claims and the foregoing exemplary descriptions should not be regarded as limiting.

What is claimed is:

1. A method of remanufacturing an imaging cartridge to permit a post test of the cartridge without activating a removal mechanism associated with an internal toner seal of the cartridge, the method comprising:

disassembling the cartridge;

removing at least one component that overlies a member that provides driving force to the removal mechanism;

replacing the member with a modified member having a mechanically coupled configuration that provides driving force to the removal mechanism and a mechanically uncoupled configuration that does not provide driving force to the removal mechanism;

at least partially reassembling the cartridge;

post testing the cartridge with the modified member in the uncoupled configuration; and placing the modified member in the coupled configuration.

2. The method of claim 1, wherein replacing the member with a modified member includes installing a driven gear including a first portion that receives driving rotatable force from a driving force receiver, and a second portion that transmits driving rotatable force to the removal mechanism, and wherein in the coupled configuration the first portion and the second portion are coupled for rotation together, and wherein in the uncoupled configuration the first portion and the second portion are rotatable relative to one another.

3. The method of claim 2, wherein placing the modified member in the coupled configuration includes applying a fixing member to couple the first portion and the second portion for rotation together.

4. The method of claim 3, wherein applying the fixing member includes inserting a pin between the first portion and the second portion.

5. The method of claim 3, wherein applying the fixing member includes sonically welding the first portion to the second portion.

6. The method of claim 1, further comprising modifying at least a portion of an end assembly of the cartridge to provide access to the modified member for placing the modified member in the coupled configuration.

7. The method of claim 6, wherein modifying at least a portion of the end assembly of the cartridge includes forming an end cap opening in an end cap.

8. A remanufactured toner cartridge comprising:

a driving force receiver for receiving a rotating driving force;

a developer roller drivingly coupled with the driving force receiver and rotating in response to the driving force receiver receiving the rotating driving force;

a driven gear operable to drive an internal toner seal removal mechanism, the driven gear including a first portion that receives driving rotatable force via the driving force receiver, and a second portion that transmits driving rotatable force to the internal toner seal removal mechanism, the driven gear having a coupled configuration in which the first portion and the second portion are coupled for rotation together, and an uncoupled configuration in which the first portion and the second portion are rotatable relative to one another; and an end assembly at least partially covering the driven gear and defining at least one opening that provides access to the driven gear for placing the driven gear in the coupled configuration.

9. The remanufactured toner cartridge claim 8, further comprising a fixing member installed via the opening and securing the driven gear in the coupled configuration.

* * * * *